US008393608B2

(12) United States Patent
Terrero et al.

(10) Patent No.: US 8,393,608 B2
(45) Date of Patent: Mar. 12, 2013

(54) SHEET FINISHING SYSTEM INCLUDING DUAL SHEET STACKING

(75) Inventors: Carlos M. Terrero, Ontario, NY (US); Richard J. Milillo, Fairport, NY (US); Brian J. Dunham, Webster, NY (US)

(73) Assignee: Xerox Corporation

( * ) Notice: Subject to any disclaimer, the term of this patent is extended or adjusted under 35 U.S.C. 154(b) by 0 days.

(21) Appl. No.: 13/094,124

(22) Filed: Apr. 26, 2011

(65) Prior Publication Data

US 2012/0274015 A1 Nov. 1, 2012

(51) Int. Cl.
*B65H 39/00* (2006.01)

(52) U.S. Cl. ..... 270/58.33; 270/52.14; 270/58.34

(58) Field of Classification Search ..... 270/52.14, 270/52.16, 30.01, 30.05, 30.1, 58.23, 58.33, 270/58.34; 271/287, 298, 300
See application file for complete search history.

(56) References Cited

U.S. PATENT DOCUMENTS

| | | | | |
|---|---|---|---|---|
| 5,110,116 | A * | 5/1992 | Kobler et al. | 271/277 |
| 5,730,436 | A * | 3/1998 | Viebach et al. | 270/52.16 |
| 6,575,461 | B1 | 6/2003 | Rider | |
| 6,722,650 | B1 * | 4/2004 | Abbata et al. | 271/213 |
| 7,410,157 | B2 * | 8/2008 | Stolz | 270/52.14 |
| 7,588,239 | B2 * | 9/2009 | Marcinik et al. | 270/52.18 |
| 7,597,324 | B2 * | 10/2009 | Obuchi et al. | 271/288 |
| 8,096,553 | B2 * | 1/2012 | Obuchi et al. | 271/298 |
| 8,152,162 | B2 * | 4/2012 | Obuchi | 271/198 |
| 2006/0119027 | A1 * | 6/2006 | Landwehr | 271/177 |
| 2008/0157466 | A1 * | 7/2008 | Fukatsu et al. | 271/303 |
| 2010/0164162 | A1 * | 7/2010 | Obuchi | 271/3.15 |
| 2010/0320679 | A1 * | 12/2010 | Miyake et al. | 271/298 |

* cited by examiner

*Primary Examiner* — Leslie A Nicholson, III
(74) *Attorney, Agent, or Firm* — Ellis B. Ramirez; Richard A. Castellano; Ronald E. Prass, Jr.

(57) ABSTRACT

A substrate finishing system includes a sheet input that feeds sheets to a compiler for compiling. The sheets may be stapled at the compiler. A trail edge support of the compiler is movable from a first position to a second position. The compiler is configured to drop a sheet or set of sheets to build compiled set stacks at the first and second positions on a stacking tray positioned beneath the compiler.

7 Claims, 4 Drawing Sheets

SHEET FINISHING SYSTEM INCLUDING DUAL SHEET STACKING

FIELD OF DISCLOSURE

The disclosure relates to apparatus, systems, and methods for expanding media stacking capacity in a print finishing system. Specifically, the disclosure relates to a finishing system for accommodating media stacking, stapling, and unload while run capabilities for printing systems.

BACKGROUND

Related art finishing systems for printing systems may include a substrate input transport, substrate compiler, and a stack tray. A typical stack tray at full capacity may carry, e.g., 3,000 sheets of 80 gsm paper or equivalent. This capacity may deteriorate due to paper curl, waviness and/or staple thickness; particularly as multiple output sheets are stacked.

SUMMARY

Uneven stack growth in related art systems, which may be caused by, e.g., staple thickness, can affect stack quality, necessitate system shutdowns, and hinder productivity. For example, output sheets may be stapled on one side of the sheet, and stacked. Stack flatness may deteriorate as the stapled side of the stack grows more rapidly. Such deterioration may significantly reduce a number of sheets or stapled sets of sheets that can be stacked reliably.

Finishing apparatus and systems in accordance with embodiments may include substrate input system and a compiling system. The substrate input system may be configured input substrates, e.g., paper sheets to the compiling system. The compiling system may be configured to compile multiple sheets, and drop a first compiled sheet set on a first stack, and drop a second compiled sheet set on a second stack. The first and second stacks may be positioned on first and second portions, respectively, of a stacking tray.

A compiler apparatus and system in accordance with embodiments may include a trail edge support and a lead edge support. The lead edge support may be stationary. The trail edge support may be constructed, configured, and/or arranged to be movable from a first position to a second position. At a first position, the trail edge and the lead edge may support opposite sides of one or more sheets or a compiled set of sheets. A stapling system may be configured at the compiler for stapling sets of sheets, the trail edge and the lead edge being configured to support and compile sets of stapled sheet sets. The trail edge may include a holding mechanism, e.g., a clamp for holding a compiled set as the trail edge moves away from a first position near the lead edge, and toward a second position. In embodiments wherein the lead edge support is stationary during movement of the trail edge support, the lead does not support the compiled set as the trail edge moves, holding the compiled set.

In embodiments, the compiling system may drop a compiled set on a first stack. The trail edge support may move to a second position, and drop a compiled set on a second stack. The compiling system may drop sheets or sheet sets on the first stack and second stack in alternation.

In embodiments, methods include compiling a set of sheets using a compiling system having a movable trail edge support member that is configured to hold a sheet or set of sheets by a side of said sheet or set of sheets, until dropping the set on a stack or stack tray positioned below the compiling system. Methods include dropping a sheet or set of sheets from the trail edge to a first stack when the trail edge is at a first position, and dropping a sheet or set of sheets from the trail edge to a second stack when the trail edge is at a second position. In another embodiment, methods may include alternating between first and second stacks when dropping sheets or sets of sheets during finishing.

Exemplary embodiments are described herein. It is envisioned, however, that any system that incorporates features of apparatus, systems, and methods described herein are encompassed by the scope and spirit of the exemplary embodiments.

DETAILED DESCRIPTION

Figure 1:
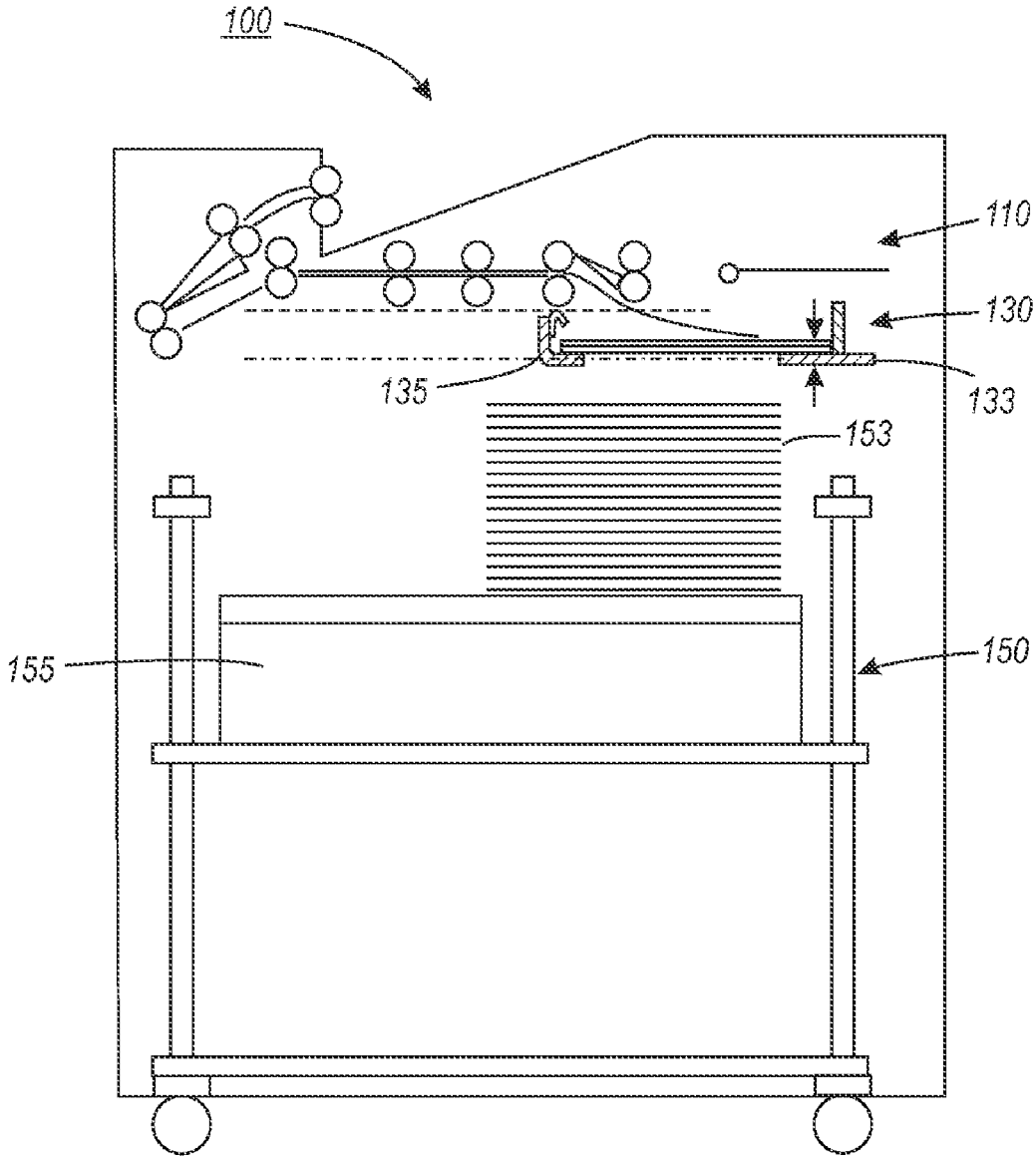
FIG. 1 shows a diagrammatical side view of a finisher system.

Exemplary embodiments are intended to cover all alternatives, modifications, and equivalents as may be included within the spirit and scope of the apparatus, systems, and methods as described herein.

Apparatus, systems, and methods of embodiments may include systems for printing images on substrates, for example, paper sheets. The sheets may be input to a finishing system for stacking.

The finishing system may include a substrate input transport. The input transport may be configured to transport substrates to a compiler or compiling system. The compiler may include a trail edge support, which may include a clamp or tamper, and a lead edge support and/or ejector. An ejection system may facilitate transfer of a completed set from the compiler onto the stack. The ejection system may comprise the ejector and tamper, or trail edge support, which may be configured to move simultaneously during set ejection. The tamper may be configured to guide as the ejector pushes the set off the lead edge support and onto a support or stack positioned below. The system may be configured so that subsequently the tamper continues its motion, removing its support to the trail edge and allowing it to fall onto the stack.

Sheets may be input to the compiler by way of the substrate input transport. The compiling system compiles sets of input sheets, and may configured to staple sheets, and compile stapled sheet sets. Specifically, the trail edge support or tamper and the lead edge support may support the sheets as they are compiled. The trail edge support may be arranged at a first position whereby one or more sheets can be supported by the trail edge support at a trail edge of the sheet while the lead edge support supports a lead edge of the sheet or set of sheets.

The trail edge support may be configured to hold the sheet(s). For example, the trail edge may include a clamp. Alternatively, the trail edge support may hold the trail edge of the sheet(s) by any suitable means for holding the sheet(s) even without the support of the lead edge or ejector. For example, the trail edge support may hold the sheet(s) while moving from the first position to a second position. The lead edge support may be stationary such that movement of the trail edge support causes the sheet(s) to move away from the lead edge support.

In embodiments, the trail edge support may be configured to move from a first position to a second position during finishing. At a first position and at a second position, the trail edge support may be configured to lose hold of or release the sheet(s), thereby allowing the sheet(s) to drop to a stack support positioned below the compiler, or to a sheet or set of sheets already positioned on a stack support. In embodiments, the compiler may be configured to drop a sheet or set of sheets on a first stack or a first stack support portion, e.g., when the trail edge support is in a first position. And, the compiler may be configured to drop a sheet or a set of sheets on a second stack or a second stack support portion, e.g., when the trail edge is in a second position. The lead edge support may be configured to eject a set of sheets. An ejection system may facilitate transfer of a completed set from the compiler onto the stack. The ejection system may comprise the ejector and tamper, or trail edge support, which may be configured to move simultaneously during set ejection. The tamper may be configured to guide as the ejector pushes the set off the lead edge support and onto a support or stack positioned below. The system may be configured so that subsequently the tamper continues its motion, removing its support to the trail edge and allowing it to fall onto the stack.

More specifically, in embodiments, the trail edge support of a compiling system may compile sheets or sets of sheets and drop them in one of a first or a second stack on portions of a stack support positioned below the compiling system. For example, the trail edge support may drop a first sheet or first set of sheets while a first position, and then after compiling a second sheet or set of sheets, the trail edge may be moved to a second position that is offset from the first position. The compiler may be configured to drop a sheet or set of sheets successively while alternating between stacks. Thus, the compiler accommodates a substantially greater substrate stack capacity than related art finishing systems, which are typically limited to a single substrate stack.

In embodiments, the compiler may be configured to staple one or more sheets to produce a stapled set. The compiler may be configured to stack stapled sets in dual stacks, whether completing each stack in succession, or alternating between stacks.

When the trail edge support is set back and long offset from the first position, a held sheet or set is not supported by the lead edge transport. In some embodiments, the trail edge substrate holding mechanism, e.g., a clamp may be configured to hold sheet(s) with a clamp force that is greater than that typically required by related art finishing systems.

Reference is made to the drawings to accommodate understanding of belt-roll fuser apparatus and systems including a finisher system with dual substrate stacking capability. In the drawings, like reference numerals are used throughout to designate similar or identical elements. The drawings depict various embodiments and data related to embodiments of illustrative finisher systems.

A finishing system is shown in FIG. 1. Specifically, the finishing system 100 of FIG. 1 includes a substrate input transport 110 that feeds a substrate, e.g., a paper sheet to a compiler 130. The input transport 110 includes a combination of rollers that facilitate transport of sheets to the compiler 130. In alternative embodiments, the input transport 110 may comprise any combination of components suitable for delivering substrates such as paper sheets to the compiler 130.

The compiler 130 may include a lead edge support member 133 that supports a lead edge of a sheet or set of sheets input to the compiler 130. An ejector may be configured near the lead edge support for facilitating ejection of a sheet or set of sheets held by the trail edge support 133 as the trail edge support 133 moves from the first position shown in FIG. 1 to a second position.

The finisher system 100 of FIG. 1 includes a stack tray 150. A stack 153 is positioned on the stack tray 150. The stack 153 is produced by sheets dropped on the stack tray 150 by the compiler 130 when the lead edge support 133 is at the first position, as shown. The shown stack 153 does not include stapled sets. In the finishing system 100, a 3,000 unstapled sheet stack of 80 gsm paper can be accommodated. The stack tray 150 may include a stack support 155.

Figure 2:
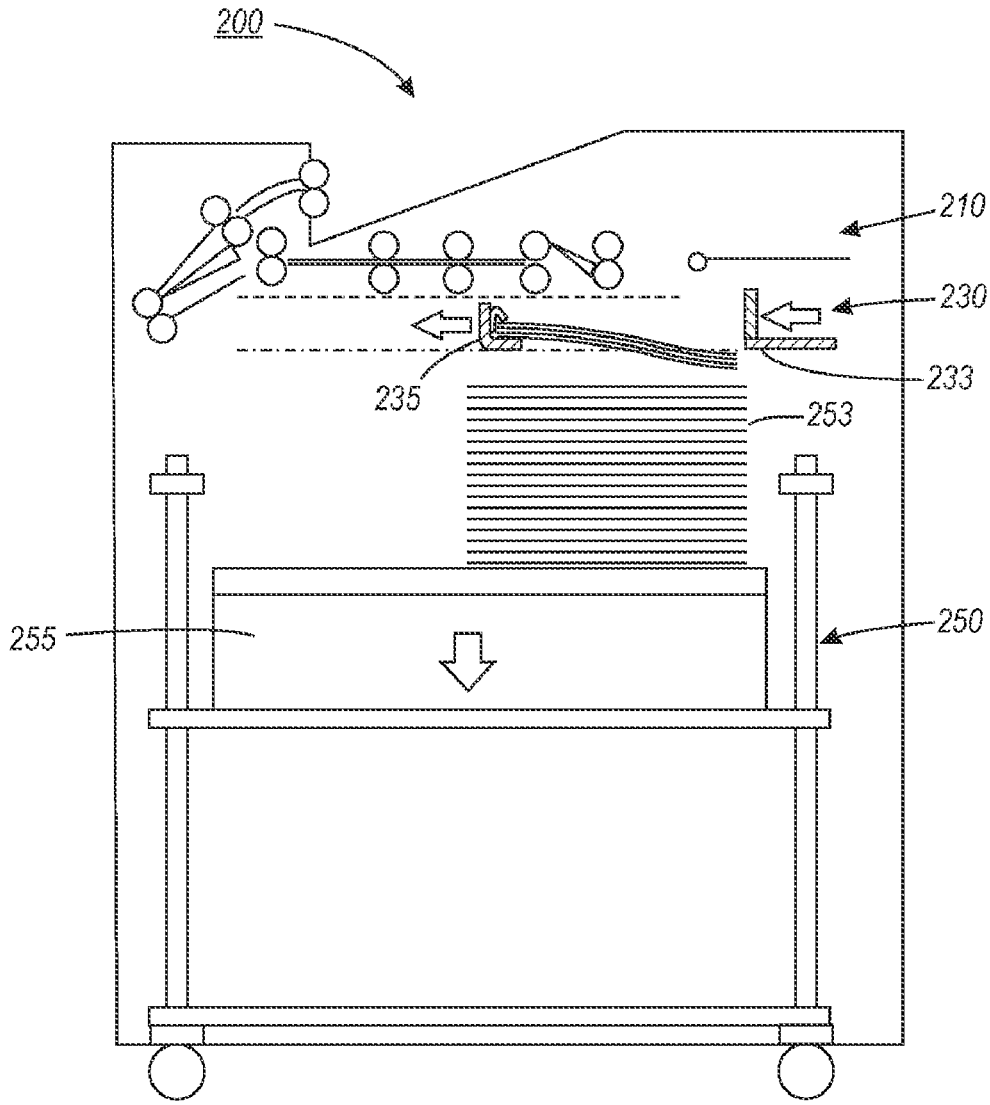
FIG. 2 shows a diagrammatical side view of a finisher system showing exemplary component movement.

FIG. 2 shows a finishing system 200 having a substrate input transport 210 and a compiler 230. The compiler may include a lead edge support 233. An ejector may be configured at the lead edge support 233 for ejecting a sheet or set. The compiler 230 shown in FIG. 2 includes a trail edge support 235 located a first position. The trail edge support 235 may include a clamp or similar mechanism suitable for holding and releasing a sheet or sheet set.

The compiler 230 may be configured to compile a set of sheets, and then drop the sheets on a first stack. The first stack may be positioned below the sheet or set of sheets held by the trail edge support 235 when the trail edge support is located at the first position, and the sheet or set is supported by the lead edge support 233. The stack may be positioned on a stack tray 250, which may include a stack support 255. The stack support 255 may include a first stacking portion and a second stacking portion. The compiler may be configured to drop a sheet down to one of the first and second portions, or both portions.

For example, when the trail edge support 235 is in a first position as shown, the compiler 230 may drop a compiled sheet or set onto the first portion of the stacking tray 255. The finishing system 200 may be arranged such that a maximum stack height limits a stacking capacity of the stacking tray 255. For example, the stacking tray 255 may accommodate a maximum of 3000 stacked sheets on either a first portion or a second portion of the stacking tray 255. FIG. 2 shows a stack of unstapled sheets located at a first portion of the stacking tray 255. If the stack includes sheets or sets having wrinkles, staples, etc., the maximum capacity of each stack may be reduced. Dual stack capacity mitigates the reduction in stack capacity caused by wrinkles, staples, etc., in comparison with related art system.

Figure 3:
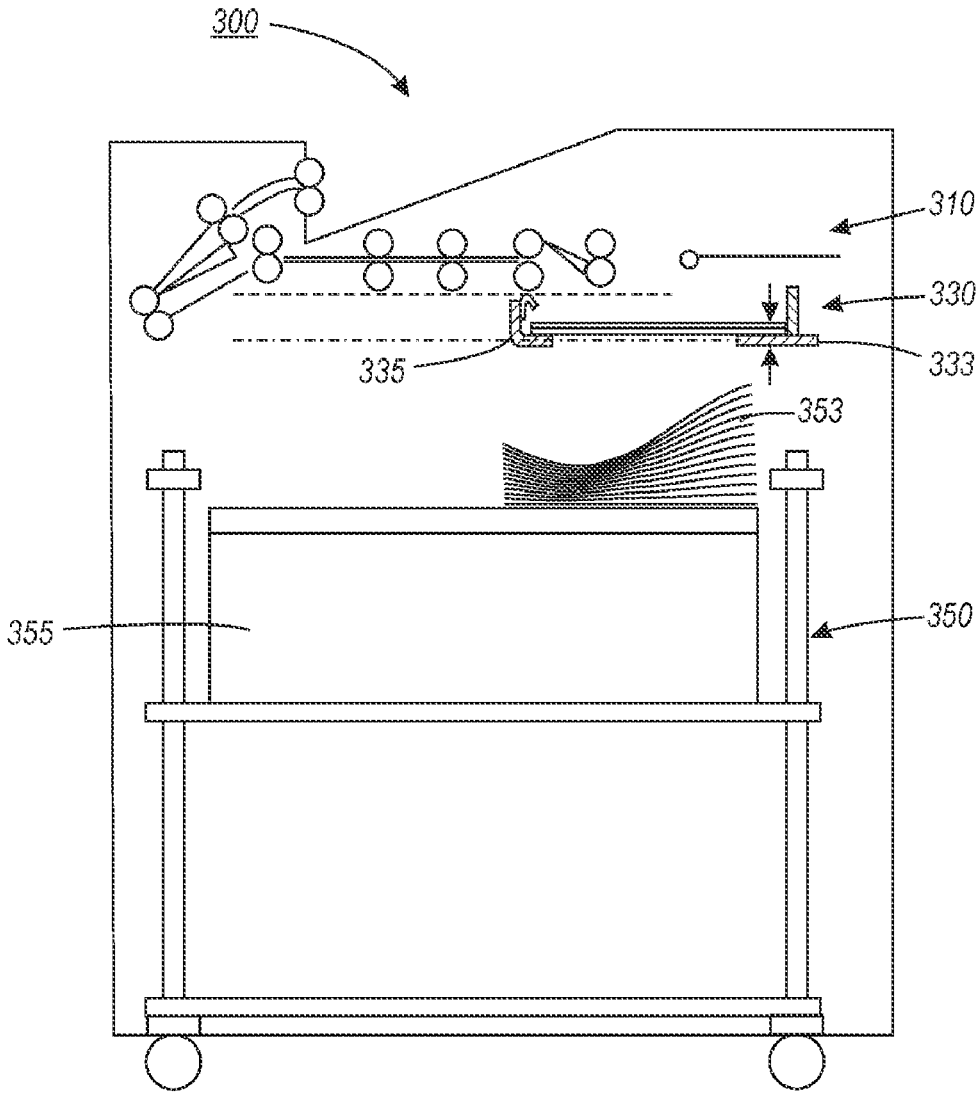
FIG. 3 shows a diagrammatical side view of a finisher system with a stapled set stack.

FIG. 3 shows a finishing system 300 including a substrate input transport 310 and a compiler 330. The compiler 330 may include a lead edge support 333. An ejector may be configured at the lead edge support 333 for ejecting a sheet or set of sheets. The compiler 330 shown in FIG. 3 includes a trail edge support 335 located a first position. The trail edge support 335 may include a clamp or similar mechanism suitable for holding and releasing a sheet or sheet set.

The compiler 330 may be configured to compile a set of sheets, and then drop the sheets on a first stack. The first stack may be positioned below the sheet or set of sheets held by the trail edge support 335 when the trail edge support is located at the first position, and the sheet or set is supported by the lead edge support 333. The stack may be positioned on a stack tray 350, which may include a stack support 355. The stack support 355 may include a first stacking portion and a second stacking portion.

The compiler 330 may be movable from a first to position to a second position. The compiler 330 may be configured to drop a sheet or set to more than one stack, thereby accommodating enhanced capacity and minimizing effects of staples, wrinkles, etc.

For example, when the trail edge support 335 is in a first position, the compiler 330 may drop a compiled sheet or set onto the first portion of the stacking tray 355. The finishing system 300 may be arranged such that a maximum stack height limits a stacking capacity of the stacking tray 355. For example, the stacking tray 355 may accommodate a maximum of 3000 stacked unstapled sheets on either a first portion or a second portion of the stacking tray 355. FIG. 3 shows a stack of stapled sheets located at a first portion of the stacking tray 355. The staples cause uneven build-up sheets, which causes an uneven and potentially unstable stack. This may limit the amount of sets that can be stacked on a stacking tray. For example, the stack 353 of FIG. 3 is uneven thereby limiting capacity.

Figure 4:
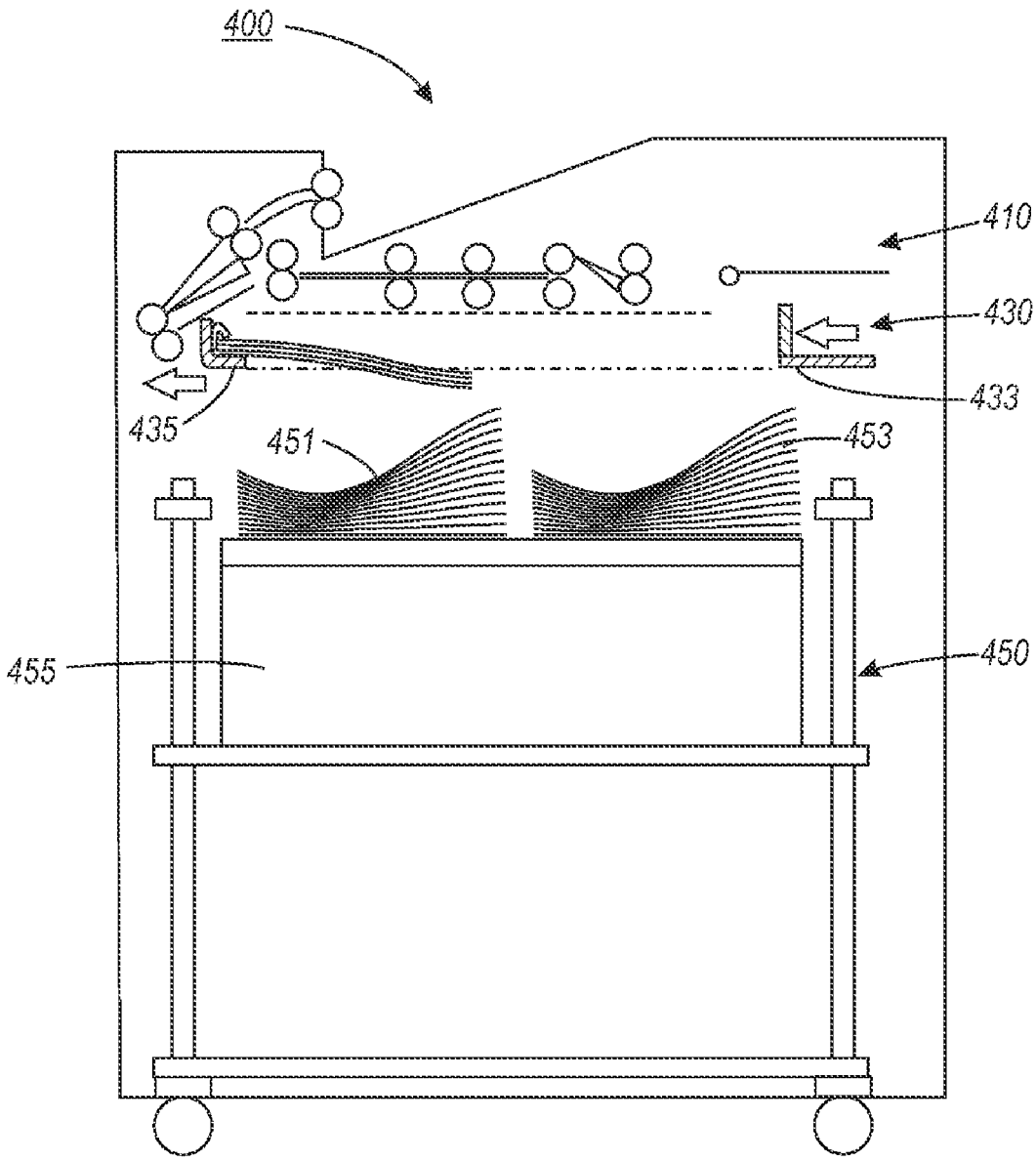
FIG. 4 shows a diagrammatical side view of a finisher system with dual stapled set stacks.

FIG. 4 shows a finishing system 400 including a substrate input transport 410 and a compiler 430 in accordance with an exemplary embodiment. The compiler 430 may include a lead edge support 433. An ejector may be configured at the lead edge support 433 for ejecting a sheet or set of sheets. The compiler 430 shown in FIG. 4 includes a trail edge support 435 located a second position. The trail edge support 435 may include a clamp or similar mechanism suitable for holding and releasing a sheet or sheet set.

The compiler 430 may be configured to compile a set of sheets, and then drop the sheets on a first stack. The first stack may be positioned below the sheet or set of sheets held by the trail edge support 435 when the trail edge support is located at the first position, and the sheet or set is supported by the lead edge support 433. The stack may be positioned on a stack tray 450, which may include a stack support 455. The stack support 455 may include a first stacking portion and a second stacking portion.

FIG. 4 shows the compiler 430 located in a second position, offset from the first position. A second portion of the stacking support 455 may be positioned below the sheet or set held by the trail edge 435 when the trail edge 435 is in the second position. The compiler 430 may drop a sheet or set of sheets at the second position, and a second sheet stack 451 may be formed on the second portion of the stacking support 455.

The compiler 430 may be movable from a first to position to a second position, and back. The compiler 430 may be configured to drop a sheet or set to more than one stack, thereby accommodating enhanced capacity and minimizing effects of staples, wrinkles, etc.

For example, when the trail edge support 435 is in a first position, the compiler 430 may drop a compiled sheet or set onto a first portion of the stacking tray 450 and stacking support 455. FIG. 4 shows a stack 453 of stapled sheets located at a first portion of the stacking tray 455. The staples cause uneven build-up sheets, which causes an uneven and potentially unstable stack. This may require limiting the amount of sets that can be stacked on a first portion the stacking tray. For example, the stack 453 of FIG. 4 is uneven thereby limiting capacity.

The compiler 430 may be moved to a second position to drop a sheet or set on a second stack 451 on a second portion of the stacking support 455, after completing a first stack 453. Alternatively, the compiler 430 may build a first stack 453 and a second stack 451 by dropping sheets or sets on each portion of the stacking support 455 in alternation. In alternative embodiments, the finishing system may be configured such that the trail edge support may be stationary, and the lead edge support may be movable to first and second positions as described.

While apparatus, methods, and systems for stacking sheets in a finishing system are described in relationship to exemplary embodiments, many alternatives, modifications, and variations would be apparent to those skilled in the art. Accordingly, embodiments of apparatus, systems, and methods as set forth herein are intended to be illustrative, not limiting. There are changes that may be made without departing from the spirit and scope of the exemplary embodiments.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art.

What is claimed is:

1. A finishing system, comprising:

a compiling system having a trail edge support; and a substrate stacking support, the compiling system being configured to selectively drop a compiled substrate set on one of a first portion and a second portion of the stacking support, the trail edge support being movable from a first position to a second position, the trail edge support being configured for reciprocating between the first position and the second position for enabling the selectively drop of the compiled substrate on the one first portion of the second portion of the stacking support.

2. The finishing system of claim 1, further comprising:

a substrate input system.

3. The finishing system of claim 1, the compiling system further comprising the trail edge support being configured to hold a substrate or set of substrates.

4. The finishing system of claim 1, the compiling system further comprising:

a clamp that holds a substrate or set of substrates, the clamp being configured on the trail edge support.

5. The finishing system of claim 4, the compiling system further comprising the clamp being configured to release a substrate or substrate set when the trail edge support is at one of a first position and a second position.

6. The finishing system of claim 5, wherein the trail edge support is configured to release a substrate or a substrate set at a first position and a second position in alternation.

7. The finishing system of claim 1, the compiling system further comprising:

a lead edge support that supports a substrate or a substrate set when the trail edge support is at the first position.

* * * * *